US005092529A

United States Patent [19]

Bechler et al.

[11] Patent Number: 5,092,529

[45] Date of Patent: Mar. 3, 1992

[54] APPARATUS FOR MANIPULATION OF IMPACTOR HAMMERS

[75] Inventors: David J. Bechler, Menomonee Falls; John S. Downs, Brookfield, both of Wis.

[73] Assignee: Nordberg Inc., Milwaukee, Wis.

[21] Appl. No.: 592,213

[22] Filed: Oct. 3, 1990

[51] Int. Cl.[5] ..... B02C 13/26

[52] U.S. Cl. ..... 241/192; 241/294

[58] Field of Search ..... 241/189 R, 192, 285 A, 241/285 B, 294, 301

[56] References Cited

U.S. PATENT DOCUMENTS 1,459,568 6/1923 Blum .
2,860,002 11/1958 Herbst .
2,958,474 11/1960 Meyer .
3,343,861 9/1967 Sinicki .
3,549,190 12/1970 Caldwell .
4,925,114 5/1990 Ostergaard .
5,005,772 4/1991 Ostergaard ..... 241/192 X

*Primary Examiner*—Timothy V. Eley
*Attorney, Agent, or Firm*—Welsh & Katz, Ltd.

[57] ABSTRACT

An apparatus for manipulating horizontal impactor hammers includes a crossbeam and a pair of depending lift arms, each lift arm having a corresponding pivot arm configured to be secured to respective ends of the hammer and to pivot about the lift arm. Once the pivot arms are attached to the ends of the hammer, the crossbeam is elevated, withdrawing the hammer from the rotor and causing the hammer to invert about the pivot axis for reinsertion into the rotor. Provisions are also made for rotating the withdrawn hammer about a vertical axis.

18 Claims, 2 Drawing Sheets

88
86
98
56
118
112
114
100
102
24
12
25
108
106
104
110
80
92
120
60
23
66
26
46
68
94
84
70
64
62
90
58
116
96
22

APPARATUS FOR MANIPULATION OF IMPACTOR HAMMERS

BACKGROUND OF THE INVENTION

The present invention relates generally to horizontal impactors, and specifically to a system for enabling the rapid manipulation, including inversion and/or rotation of impactor rotor hammers without removing the hammers from the impactor.

The rotors of horizontal impactors are provided with hammers which engage the work to be crushed or pulverized. Although these hammers are manufactured of wear resistant alloys, they become worn in a relatively short period of time. As a result, such impactors must be periodically shut down to permit the replacement of at least one of the hammers in the rotor.

In conventional impactors, the hammer is optimally positioned in the rotor to maximize the wear material utilization, maintain crushing efficiency, and prevent premature rotor wear. When worn to a certain point, the hammers are designed so that they can be inverted to a horizontal axis, rotated about a vertical axis, flipped end-to-end, or otherwise adjusted to a new position within the rotor to make the most efficient use of the hammer material. This process involves multiple handling of the heavy and cumbersome hammers, which are usually completely removed from the crusher. Consequently, a worker safety problem is created by the handling of the bulky hammers. Also, the task of repositioning the hammers for crushing efficiency can be complicated.

Thus, there is a need for a system for replacing and repositioning impactor rotor hammers in which the handling of the hammers is minimized, and in which the accurate repopsitioning of the hammers within the rotors is facilitated.

SUMMARY OF THE INVENTION

Accordingly, the present invention provides a method and apparatus for manipulating impactor hammers in which the installation and/or adjustment of the hammer position may be accomplished in a relatively simple operation. Positive control over hammer manipulation is maintained with a minimum of worker handling, and without the need for removing the hammer from the crusher. Thus, the present system provides for safe, positive control over the hammer manipulations.

More specifically, the present invention includes a rotor hammer which preferably has two threaded inserts in each hammer end. The inserts are preferably vertically offset from a horizontal center line of the hammer. Locating indicators are etched into at least one hammer end to provide the operator with a visual indication of proper hammer position within the rotor. In addition, a lifting device is provided including a crossbeam with locating notches for accommodating varying hammer lengths, and a pair of depending lifting arms, each with a pivot arm pivotally attached thereto. Each pivot arm has a fastening apparatus for securing the arm to one of the inserts in the hammer end. A locking device controls the pivoting action of the pivot arms and the hammer. The hammer may be inverted, i.e., flipped out its horizontal axis and/or rotated about its vertical axis.

DESCRIPTION OF THE PREFERRED EMBODIMENT

Figure 1:
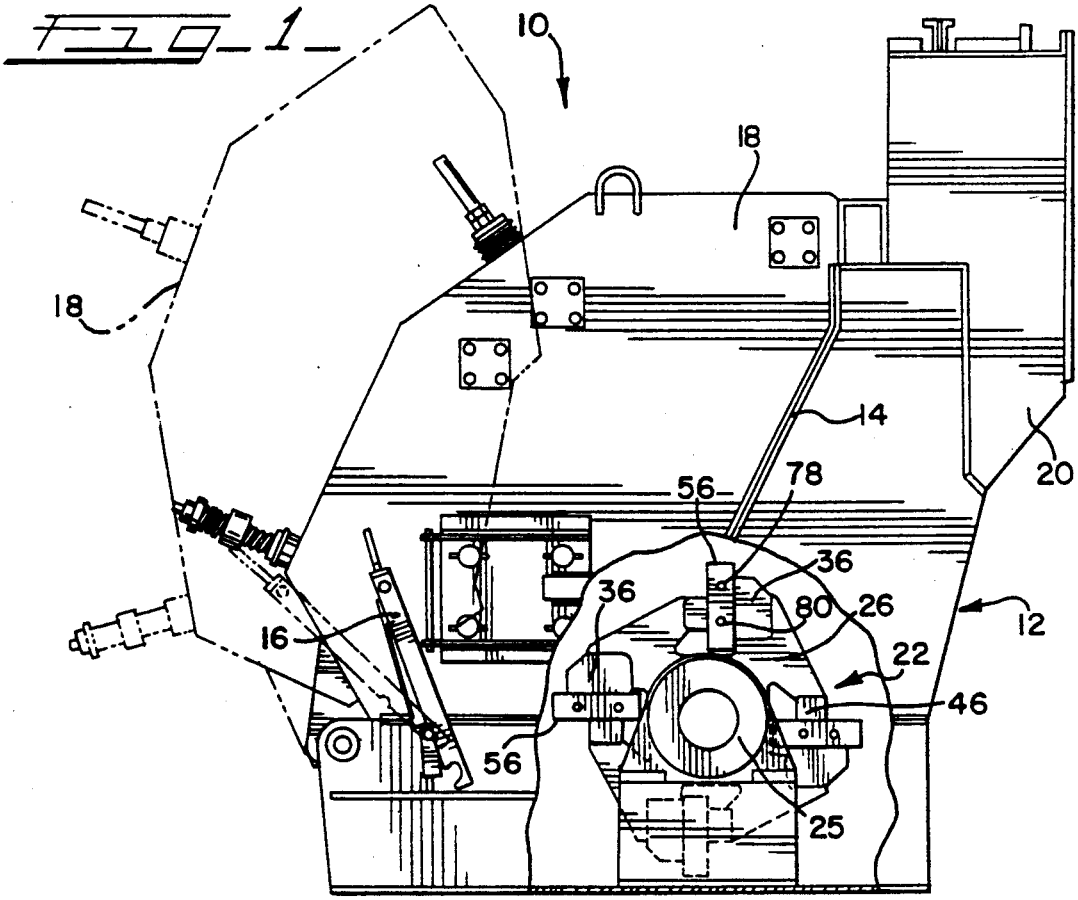
FIG. 1 is a side elevational view of a horizontal impactor of the type suitable for use with the present invention, with portions shown broken away for clarity.

Referring now to FIG. 1, a horizontal impactor is generally designated 10. The impactor 10 includes an outer housing or frame 12 which is designed to open hydraulically along a line or seam 14. A hydraulic jack and locking arm 16 is used to separate the frame 12 into a movable portion 18 and a fixed portion 20, the opened position of the impactor 10 being illustrated in phantom in FIG. 1. Once the two portions, 18 and 20 are separated, maintenance operations may be performed as required on components of the impactor 10, such as the rotation or inversion of the impactor hammers.

Figure 2:
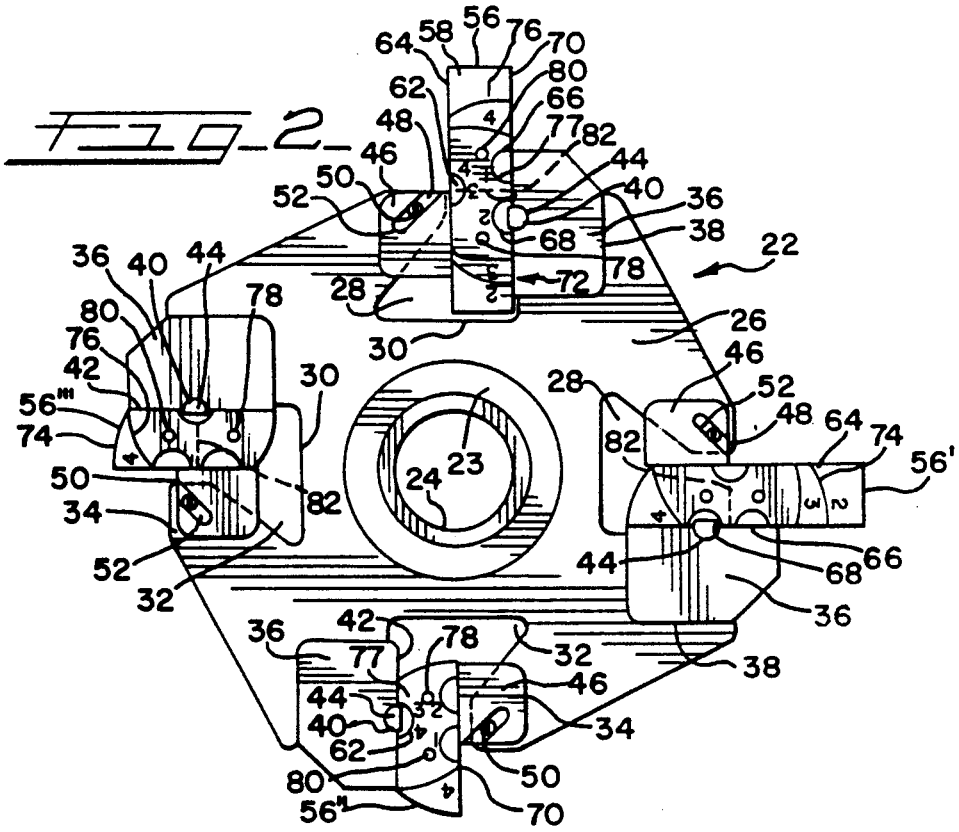
FIG. 2 is a side elevational view of a rotor incorporating the present invention.
Figures 3, 4:
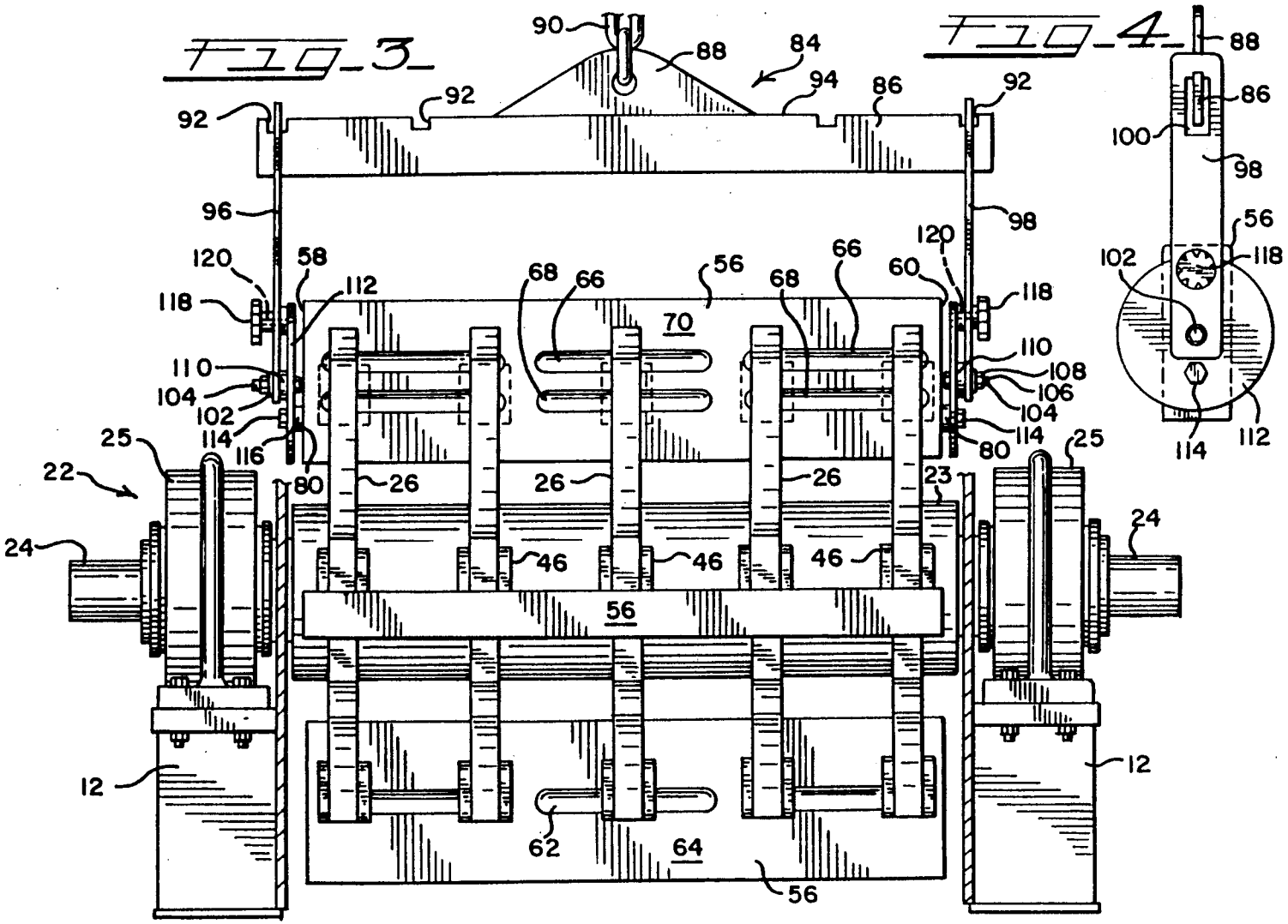
FIG. 3 is a front elevational view of the present rotor hammer lifting apparatus secured to an impactor hammer.
FIG. 4 is a side elevational view of the rotor hammer lifting apparatus depicted in FIG. 3.

Referring now to FIGS. 1–3, an elongate rotor 22 is disposed for rotation within the frame 12. The rotor 22 may be driven by a belt and pulley apparatus (not shown) or by other conventional drive systems. The rotor 22 includes a central tube 23 preferably fabricated of centrifugally cast steel, and having a stub shaft 24 fixed at each end of the tube. The rotor 22 is secured to the frame 12 by a pair of pillow block bearings 25, each of which operationally supports one end of the stub shaft 24.

A plurality of rotor ribs 26 are secured, such as by welding in spaced relationship to the tube 23 so as to extend peripherally around the tube. Each rib 26 is configured to define a plurality of hammer recesses 28, four such hammer recesses preferably provided in each rib 26. Each hammer recess 28 has a generally horizontal base 30 and a forwardly projecting wedge-shaped cavity 32. Each cavity 32 is defined by a fillet or disk rib 34 which is an integral part of the rib 26. The recesses 28 are each provided with a corresponding elongate, rigid backing beam 36 secured to a rear edge 38.

A transverse, generally cylindrical groove 40 is disposed in a front face 42 of each of the backing beams 36, and is dimensioned to slidingly accommodate a hammer retaining pin 44. The hammer recesses 28 are also partially defined by a hammer shoe 46 which is pivotally and slidingly secured to an end 48 of the fillet 34 by a replaceable fastener 50 such as a clevis pin. The hammer shoes 46 are also preferably provided with an angled slot 52 to facilitate the release of the shoes during the hammer removal process.

A rotor hammer 56 is provided for insertion into each of the hammer recesses 28. Each hammer 56 is an elongate casting of wear resistant alloy such as an alloy of manganese, and has a pair of truncated ends, 58, 60, respectively. The hammers 56 are relatively rectangular in cross-section to permit their inversion or rotation and replacement into the recesses 28 to optimize the use of the wear material. It is common for a hammer 56 to be inverted and also to be rotated about its vertical axis at least once during its operational life.

Each hammer 56 is provided with a single elongate transverse recess or groove 62 on a first face 64, and a pair of such recesses or grooves 66, 68, respectively, on a second face 70. The grooves 62, 66 and 68 are dimensioned to engage the hammer retaining pin 44 when the hammer 56 is positioned in the recess 28 so that one of the respective grooves 62, 66, 68 is opposite the pin 44 in the backing plate 36. Several grooves, 62, 66, 68 may be employed along the length of the rotor 22 (best seen in FIG. 3). The hammer retaining pin 44 serves to prevent lateral as well as radial movement of the hammers 56. The hammer grooves 62, 66, 68 are required to facilitate this lateral retention.

To facilitate the hammer inversion operation and also to maximize the use of hammer material, the hammer 56 of the invention is provided with markings 72 etched in, or otherwise permanently affixed to, at least one and preferably both ends 58, 60. The markings 72 include wear profiles 74 at which each change or inversion should be made, as well as numbers 76 indicating the preferred sequence of inversions for obtaining the optimum use of the hammer material (markings best seen in FIG. 2). The hammer 56 may also be provided with markings 77 which indicate the preferred rotational sequence of the grooves 62, 66, 68 and their respective engagement with the pin 44. The present hammers 56 are also equipped with a pair of inserts respectively designated 78 and 80 located on a vertical axis relative to each other, and disposed so as to be vertically offset from an imaginary horizontal center line 82 of the hammer cross-section. The inserts 78, 80 are preferably internally threaded or tapped; however other types of fastening formations are contemplated.

Referring now to FIGS. 3 and 4, the present invention also includes an apparatus for lifting and rotating or inverting the hammers 56 in the hammer recesses 28 of the rotor 22. This lifting apparatus, generally designated 84, includes a rigid crossbeam 86 with a lifting eyelet 88 to which may be attached a hook or a chain 90 for manipulating the crossbeam in and out of the opened impactor 10 (best seen in FIG. 1). The hook or chain 90 may also be used to pivot the raised hammer 56 about its vertical axis. The crossbeam 86 also includes a plurality of notches 92 along an upper edge 94. The notches 92 are located in regularly spaced intervals relative to the center of the crossbeam 86.

The lifting apparatus 84 also includes a pair of lifting arms, 96 and 98, respectively, which are each provided with an opening 100 located at an upper end thereof. The opening 100 is configured to be seated within one of the notches 92. Each of the lifting arms 96, 98 also has a pivot bore 102 disposed at a lower end thereof.

The pivot bore 102 is configured to pivotally accommodate a pivot pin 104, which in the preferred embodiment, may be a threaded bolt 106 with a locknut 108 and a washer or bushing 110. The pivot pin 104 secures a pivot arm 112 to each of the lifting arms 96, 98 so that the pivot arm pivots relatively freely about the pivot pin 104. Although depicted as being circular, the pivot arms 112 may be provided in any suitable shape.

Each of the pivot arms 112 is provided with a locking bolt 114 which is configured for threaded engagement with either one of the inserts 70, 80. If desired, two such bolts 114 may be provided, one for each of the inserts 78, 80. A locking bushing 116 may be used to retain one locking bolt 114 upon each of the pivot arms 112. In this manner, once the locking bolts 114 are threaded into the inserts 78, 80, and the crossbeam 86 lifts the hammer 56 out of the rotor 22, the pivot arms 112 and the hammer 56 pivot as a unit about the pivot pins 104. In order to control the pivoting action of the hammer 56 and the pivot arms 112 about the pivot pins, a locking knob 118 with a threaded shaft 120 (shaft shown hidden in FIG. 3) is provided in each lifting arm 96, 98 in a location which will engage the pivot arm 112 near the peripheral edge thereof. The locking knob 118 is rotated in a clockwise direction so as to restrain the pivot arms 112 from pivoting by exerting an inward pressure on the arms 112, thus impeding the pivoting action around the pivot pins 104.

In operation, when the hammers 56 of the rotor 22 require changing, the impactor 10 is opened along the seam 14. The lifting arms 96, 98 are positioned in the appropriate notches 92 on the crossbeam 86 to correspond to the length of the hammer 56. The crossbeam is then lowered into the impactor 10 by a hoist or crane (not shown) so as to be in operational proximity to the rotor 22. The pivot arm 112 are placed close to the ends 58, 60 of the hammer 56, and the locking bolts 114 are threaded into the lowermost insert 78, 80, which is also on that portion of the hammer 56 which has experienced a less degree (if any) of wear.

Next, the hammer shoe retaining pin 50 is removed so that the hammer shoe 46 may be slid away from the hammer 56 and falls into the cavity 32 in the rib 26. This operation is performed at each end of the hammer 56. The locking knobs 118 are threaded against the pivot arms 112 to prevent any unwanted pivoting action or lateral movement. The hammer 56 is free to fall forward away from the retaining pin 44 and is then lifted free of the hammer recesses 28 of the rotor 22. At this point, if the hammer 56 must be replaced, it is removed from the impactor 10. However, if the hammer 56 only requires inversion and/or rotation, an advantage of the present invention is that this manipulation may be accomplished without removing the hammer 56 from the impactor 10.

Assuming that the hammer 56 retains some useful service life, once the hammer 56 is free of the rotor 22, the locking knobs 118 may be unscrewed. As soon as the locking knobs 118 are released, the offset location of the insert 80 on the hammer 56 combines with the differential hammer wear to cause the hammer to invert. The locking knobs 118 are then retightened, and, when necessary, the cross beam 86 can be rotated 180° about its vertical axis to reorient the hammer 56, and the crossbeam is then lowered so that the hammer 56 may be replaced into the rotor 22. The hammer 56 may be thus rotated about its vertical as well as inverted about its horizontal axis. It is preferred that a hammer be rotated once and inverted twice during its operational life, so that all four corners may experience wear. The operator may use the hammer end indicators 72 to properly position the hammer 56 within the rotor to use the proper groove 62, 66, 68 for the optimum positioning of the retaining pins 44. In order to reinstall the hammer 56, the removal process is reversed, with the hammer shoes 46 and the hammer shoe retaining pins 50 being replaced to their normal operational positions. This process may be repeated for as many hammers 56 as need manipulation or replacement.

Referring now to FIG. 2, the rotor 22 is shown having hammers 56 in various stages of inversion and wear. The hammer 56 shown at the top of the rotor 22 is a new hammer, and as such the retainer pin 44 is located in the groove 68. Moving clockwise around the rotor 22, the hammer 56' has been inverted once and rotated once, so that the wear profile indicator 76 indicates a "2" as the next surface to be worn, and the retainer pin 44 is located in the groove 68. Moving further clockwise, the hammer 56'' has been inverted twice and rotated once, so that the wear profile indicator "4" is visible and is the next surface to be worn, and the retainer pin 44 is located in the groove 62. The fourth hammer 56'' has experienced the same degree of wear as the hammer 56''.

It can now be seen that the present system for manipulating impactor hammers provide a safe, accurate and efficient improvement over conventional systems. Hammer adjustment can now be accomplished with a minimum of hammer movement, and with maximum control over the hammer during the manipulation process.

While a particular embodiment of the method and apparatus of manipulating impactor hammers of the invention has been shown and described, it will be appreciated by those skilled in the art that changes and modifications may be made thereto without departing from the invention in its broader aspects and as set forth in the following claims.

What is claimed is:

1. An apparatus for manipulating impactor hammers having opposing ends and being operationally located in an impactor rotor, the apparatus comprising:

a crossbeam;

a pair of lifting arms, each of said arms having an upper end configured to engage a corresponding portion of said crossbeam, and a lower end having a pivot point;

a pivot arm pivotally secured to each of said lifting arms at said pivot point; and means for releasably attaching each of said pivot arms to a respective one of the ends of the impactor hammer when the hammer must be manipulated, so that as said crossbeam is lifted, the hammer is lifted from the rotor and selectively pivots with said pivot arms .

2. The apparatus as defined in claim 1 further including means for locking at least one of said pivot arms to said corresponding lifting arm.

3. The apparatus as defined in claim 2 wherein said locking means is a locking knob on said lifting arm, said knob adapted so that, upon rotation, it directs a biasing force against said pivot arm.

4. The apparatus as defined in claim 1 wherein said means for attaching said pivot arm to the impactor hammer includes at least one insert disposed in each end of the hammer and a locking bolt on at least one of said pivot arms which threadably engages a corresponding one of the inserts on the hammer.

5. The apparatus as defined in claim 1 wherein said crossbeam is provided with means for adjusting the relative position of said lifting arms.

6. The apparatus as defined in claim 5 wherein said adjusting means includes at least one locating notch disposed in an upper portion of said crossbeam for engaging an upper end of one of said lifting arms.

7. The apparatus as defined in claim 1 wherein said crossbeam is adapted to be rotated about its vertical axis to reorient the hammer.

8. A system for manipulating the hammers for a rotor of a horizontal impactor, comprising:

at least one elongate impactor hammer having opposing ends;

an elongate crossbeam;

a pair of lifting arms, each of said arms having an upper end configured to engage a corresponding portion of said crossbeam, and a lower end having a pivot pin secured thereto;

a pivot arm pivotally secured to each of said lifting arms at said pivot pin; and means for attaching each of said pivot arms to a respective one of said ends of one of said at least one hammer.

9. The system as defined in claim 8 wherein each of said hammer ends is provided with at least one threaded insert being vertically offset on said hammer end and configured for attachment to a respective one of said pivot arms.

10. The system as defined in claim 9 wherein each of said pivot arms includes means for attaching said arm to one of the inserts in the impactor hammer

11. The system as defined in claim 8 wherein at least one of said ends is provided with locating indicators.

12. The system as defined in claim 10 wherein said indicators are etched into said hammer ends.

13. The system as defined in claim 10 wherein said locating indicators include wear profile indicators and sequential indicators.

14. The system as defined in claim 8 further including means for locking at least one of said pivot arms to said corresponding lifting arm.

15. The system as defined in claim 14 wherein said locking means is a locking knob on said lifting arm, said knob having a threaded shaft configured to engage said pivot arm.

16. THe system as defined in claim 8 further including locking means on said rotor for securing said hammer in said rotor.

17. The system as defined in claim 16 wherein said locking means includes a retaining pin and a hammer shoe.

18. A horizontal impactor hammer for use with a system for manipulating said hammer in the rotor of the impactor, the system including a crossbar and a pair of lift arms depending from said crossbar, each of said lift arms having a corresponding pivot arm configured for attachment to said hammer and for pivotal engagement with said lift arm, said hammer comprising:

an elongate body with a pair of opposite ends, each of said ends having an etched indicator pattern for indicating the wear-induced sequence of manipulation of said hammer in the rotor; and at lease one vertically offset insert disposed on each end of said hammer and configured for engagement with the pivot arm.

* * * * *